United States Patent [19]

Dits

[11] 4,192,222

[45] Mar. 11, 1980

[54] POWER PISTON APPARATUS

[75] Inventor: Herbert R. Dits, Schmelz, Fed. Rep. of Germany

[73] Assignee: Transform Verstarkungsmaschinen Aktiengesellschaft, Bous, Fed. Rep. of Germany

[21] Appl. No.: 815,015

[22] Filed: Jul. 12, 1977

[30] Foreign Application Priority Data

Jul. 13, 1976 [DE] Fed. Rep. of Germany ..... 2631479

[51] Int. Cl.[2] ..... F01B 25/04; F15B 11/22; F01B 7/00

[52] U.S. Cl. ..... 91/517; 91/171; 91/189 R; 91/520; 92/151; 60/546

[58] Field of Search ..... 91/171, 517, 520; 60/546, 561

[56] References Cited

U.S. PATENT DOCUMENTS

| | | | |
|---|---|---|---|
| 3,143,924 | 8/1964 | Pearson et al. | 91/171 |
| 3,636,817 | 1/1972 | Shapiro | 91/171 |
| 3,769,881 | 11/1973 | Aoki | 91/171 |
| 3,805,530 | 4/1974 | Richardson | 91/171 |

*Primary Examiner*—Paul E. Maslousky
*Attorney, Agent, or Firm*—Lee C. Robinson, Jr.

[57] ABSTRACT

A power piston apparatus, comprising two or more double acting hydraulic piston drive means in which the cross-sectional areas of the pistons are identical and the cylinder spaces or chambers of which are hydraulically interconnected in crossed fashion above and below the pistons in the case of two cylinders, while being connected in series in the case of more than two cylinders having separately closed oil spaces of identical volumes, with each such oil space being connected to a positive-pressure oil supply through check valves for replenishing the leakage oil, and wherein said piston drive means have associated therewith metering cylinders with a coaxial and/or parallel direction of stroke, i.e. with mechanical connections between the ends of the piston rods.

7 Claims, 4 Drawing Figures

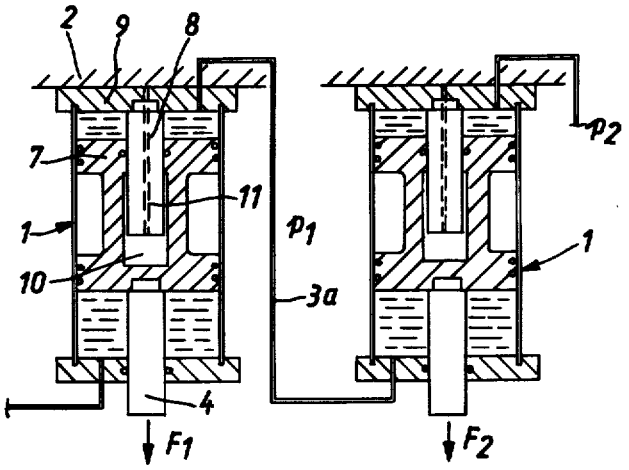
Fig. 1
Fig. 2
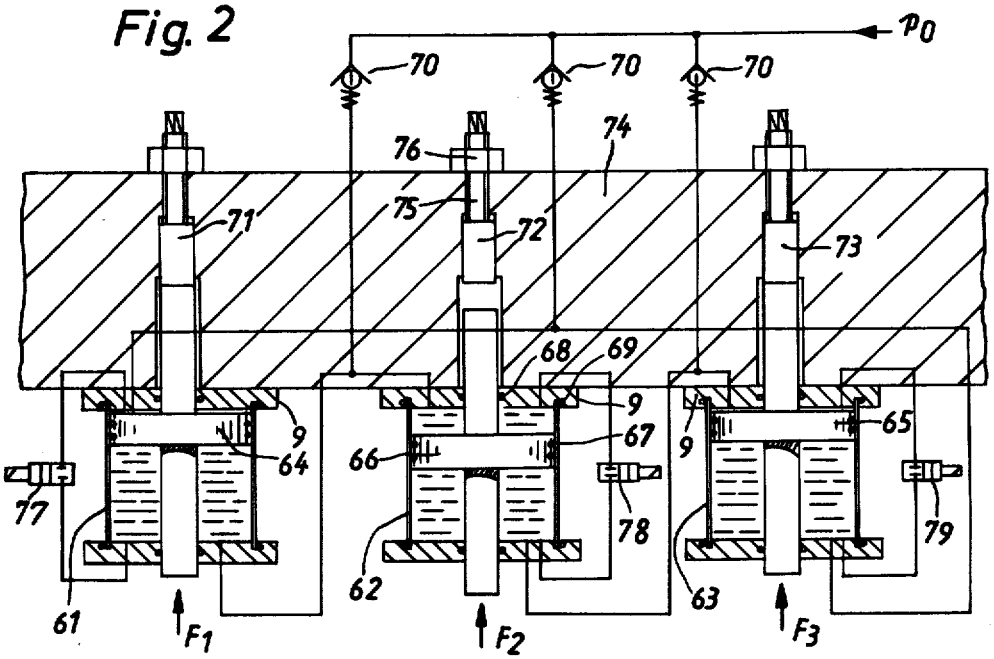

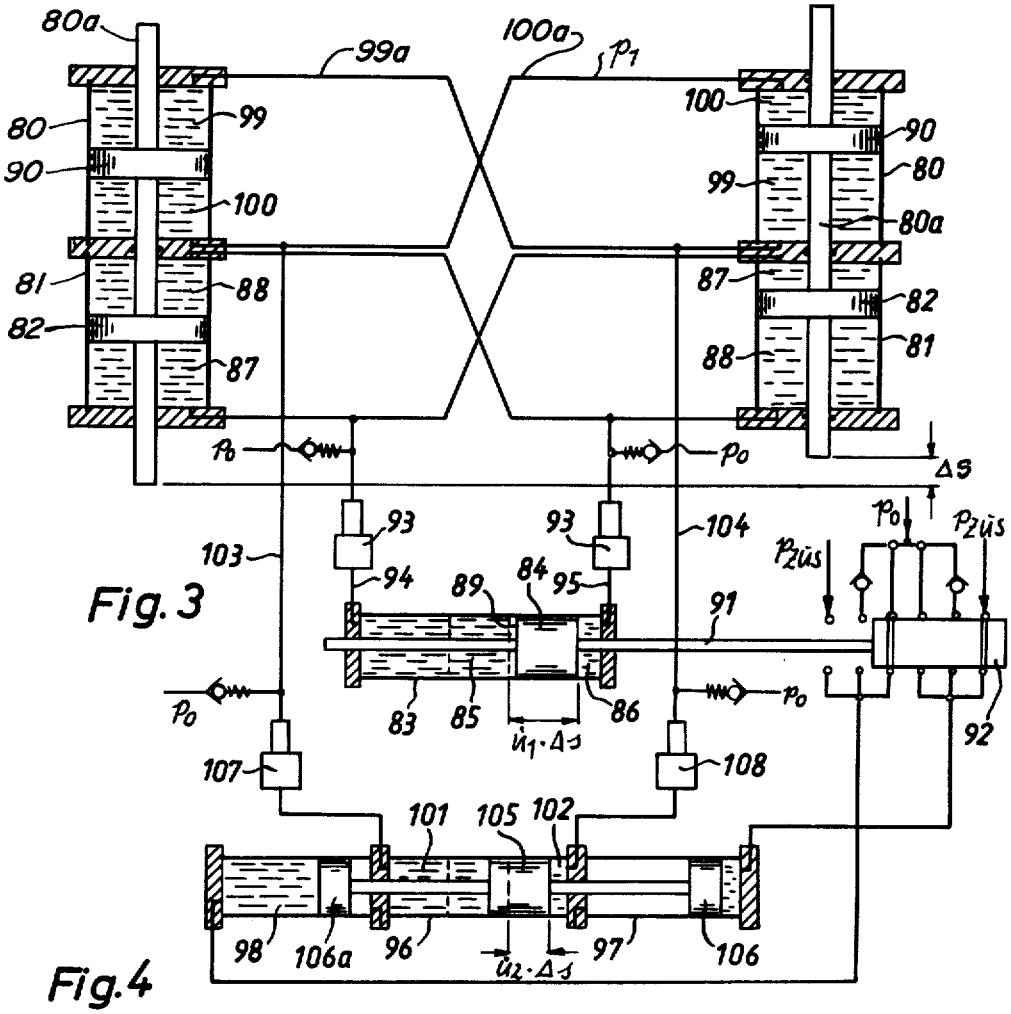
Fig. 3
Fig. 4
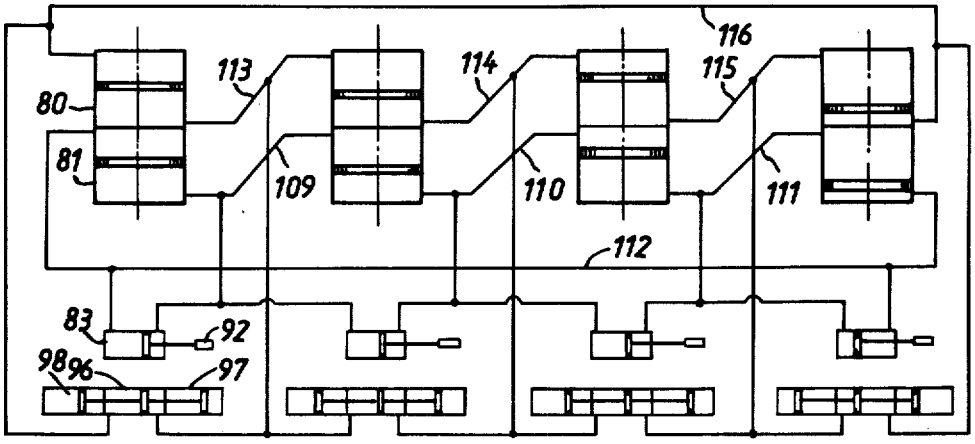

POWER PISTON APPARATUS

BACKGROUND OF THE INVENTION

A conventional synchronization control system of this type (Austrian Pat. No. 269,602 or German patent applications Nos. 1,004,924 and 2,438,557) can be applied to an open oil (hydraulic) circuit only.

An object of the present invention is in general the improvement and specifically the broadening of the scope of applicability or versatility of synchronization control systems, for instance, for use in piston drive or power means of the closed-loop oil circulation system type in which the power pistons to be synchronized are subject both to compression and tension forces, as is the case e.g. of the parallel control of a canting or cogging moment. Hereby, the sum of all piston forces is zero. The improvement according to the invention should be obtained in a structurally easy and simple and operationally safe manner, while inaccuracies are eliminated in self-compensating fashion.

SUMMARY

Accordingly, one embodiment of the present invention resides in that coaxially adjustable abutments are provided at the terminal points of the return strokes of said piston rods, and valves, e.g. electrically operated valves, are positioned within the connection lines between the upper and lower volumes of each cylinder. These valves are opened only in the interval corresponding to the dead center of the return stroke. The displacement of a control piston within a control cylinder hydraulically connected to the metering cylinders, as caused by an incorrect position of one of said piston drive means, results in that driving pistons are supplied with pressure or relieved from pressure through a slide valve rigidly coupled to e.g. a piston rod of said control cylinder. As a consequence of the displacement (V) of said driving pistons while simultaneously moving said power piston up to its centered position within the cylinder, the (swept) volume spaces or chambers of said piston drive means are forcibly adjusted to identical volumes.

As compared to the conventional constructions, this system according to the invention offers the additional advantage that a large transmission ratio may be provided within the control circuit. The ratio may be still further increased, but also decreased alternatively, by a pressure/travel transducer. This has the consequence that even minor speed variations of one piston drive means relative to a second piston drive means operating in parallel with the former, induce the necessary switching or adjusting travel of the slide valve such that a position correction is effected immediately. In this way, the adjustment or control of respectively identical positions of all of the synchronized power pistons is simplified.

Thus, the synchronization control according to the invention considers both the reduction in volume of the oil quantity with increasing pressure, and the increase in volume with decreasing pressure as well as the position errors or variations of the power pistons resulting in the course of time from leakage of sweeping oil via the piston seals from one cylinder chamber into the other cylinder chambers.

Accordingly, another principle according to the present invention resides in the feature that pressure/travel transducers are installed in the connection lines between said metering cylinders and said control cylinder and/or into the connection lines between the synchronized power cylinders and the power cylinder.

A substantial structural simplification is obtained when said control cylinder, said slide valve and a plurality of driving cylinders are combined within a control block or module.

Furthermore, the arrangement may be such that in the case of more than two piston drive means to be synchronized, each pair of piston drive means has associated therewith in cyclic sequence and with hydraulic circuit connection, a control cylinder, a spool-type slide valve and a combination of driving cylinders.

According to the invention, a further improvement with respect to the arrangement of the displacement body in a power piston having working faces of identical sizes (areas) on both sides thereof resides in the feature that a piston rod is mounted to the one side thereof, said piston rod protruding from the cylinder body in sealed relation thereto, and that at the opposite side a displacement body is secured to the cover of the synchronized power cylinder so as to extend into a recess or aperture in the associated piston by being sealed relative thereto at the upper side of the piston, and so as to be axially movable within said recess or aperture.

BRIEF DESCRIPTION OF THE DRAWINGS

Below, the present invention is explained in greater detail in a preferred embodiment by referring to the enclosed drawings, wherein:

FIG. 1 is a cross-sectional view of a synchronized cylinder connected in series with a power cylinder and operating in accordance with the present invention;

FIG. 2 is a cross-sectional view of an apparatus according to the invention to provide for a position correction of one or more synchronized pistons operating in accordance with the principle of the invention;

FIG. 3 is a schematical view, partly in cross-sectional presentation, showing the use of the synchronized cylinders according to the invention; and FIG. 4 shows the principal (basic) arrangement of the hydraulic circuit connection of the control device according to FIG. 3 for more than two, e.g. four, synchronized cylinders.

DESCRIPTION OF CERTAIN PREFERRED EMBODIMENTS

As shown in FIG. 1, a synchronized cylinder 1 mounted to an abutment or support 2 is provided with a twin or dual piston 7 having securely connected thereto a power transmitting piston rod 4, while the cylinder cover 9 has mounted thereto an idler piston rod 8 acting as a displacement body or element. This idler piston rod extends into an aperture or recess 10 provided in the twin piston 7. A bore 11 which may be formed, for instance, in said idler piston rod 8, provides for pressure compensation within said aperture 10. Alternatively, a similar bore 11 may be provided also in the power transmitting piston rod 4.

The diameters of the power transmitting piston rod 4 and of the idler piston rod 8 are identical. The diameter of a synchronized cylinder 1 may be smaller, identical or greater than the diameter of the associated power piston. In the case of a plurality of synchronized cylinders 1, these cylinders, as a rule, should be of identical size among themselves. The forces $F_1+F_2$ transmitted by the power transmitting piston rod 4 (and corresponding to the pressure $p_2$) likewise may be of any desired magnitude, with the sum of this force being defined as follows:

$$\Sigma F_{1-n} = P_1 \cdot n \cdot A$$

wherein:

$p_1$ is the supply or inlet (bias) pressure (in bars);

A is the effective surface area of the power piston;

n is the number of cylinders.

On principle, it may be distinguished between two fields of application:

(I) Among a plurality of synchronized cylinders, at least one cylinder thereof has the synchronized piston securely connected to a power piston by a power or force delivering piston rod. The piston or plunger forces $F_1$, $F_2 \ldots F_n$ produced are active in the same direction. The magnitude of the various piston or plunger forces depends on the position of the point of attack (point of engagement) of the resulting resitance $W_r$, whereby the sum of these forces results from the equation $(F_1+F_2+\ldots F_n)=W_r$. The piston or plunger strokes are of the same length each.

(II) In the case of two or more synchronized pistons, none of these pistons is rigidly connected to a power or force delivering power piston rod. The sum of the piston or plunger forces results from the equation $(F_1+F_2+\ldots F_n)=\phi$. The magnitude and the sign of these forces depend on the direction and the relative location of the power or force F applied and on the resistance $W_r$ to be overcome (eccentric load).

An apparatus for the automatic correction of an incorrect position of one or more sychronized pistons with automatic leakage oil compensation is shown in FIG. 2. Assume that in this construction three synchronized cylinders 61, 62 and 63 are provided, with two synchronized pistons 64 and 65 being in the correct position while the third synchronized piston 66 assuming an improper position.

This incorrect position may be due to two causes:

(1) Oil can leak through the piston seal means 67.

(2) Leakages exist in the cylinder chambers above and below the piston, either in the piston rod seals 68 or in the cylinder seals 69.

Leakage paths extending to the outside, furthermore, involve the danger that air may enter the cylinder chambers, whereby the rigid (inelastic) liquid coupling becomes elastic and the synchronized movement is rendered inaccurate.

These disadvantages are avoided by two measures being characterized in that, firstly, all cylinder spaces or chambers are placed under a constant basic pressure $Po>1$ bar, and, secondly, that upon reaching a dead center position, the pistons are urged against the cylinder cover 9, or the piston rod is urged against an axially adjustable abutment by external forces, such that these elements re-assume their correct position relative to each other, whereby the upper cylinder chamber is momentarily connected (communicated) to the lower cylinder chamber, for example, by an electrically controlled valve 79, for correction purposes.

In the embodiment shown, the basic pressure $p_o$ is applied through ball-type check valves 70 also to those cylinder chambers which are normally unpressurized during the operating process. Accordingly, only oil is allowed to leak out, whereas air can never enter the chambers.

The correction of position of the synchronized pistons 64, 65 or 66 takes place in every stroke such that any irregularities cannot add to each other in the course of the operation process. In the embodiment shown, the adjustment stops comprise cylindrical bolts 71, 72 and 73 mounted for axial adjustment in the machine frame 74 and adapted to be locked by means of a threaded stud 75 and a lock nut 76. Thus, a correction of position takes place automatically when the external forces $F_1$, $F_2$ and $F_3$ are produced and when valves 77, 78 and 79 are opened in the dead center position.

A positive pressure of from 1 to 2 bars may be sufficient to prevent air from entering the hydraulic system. In this way, the influence of the leakage is eliminated by the constant replenishing of oil.

The apparatus according to FIG. 3 functions to forcibly maintain identical lengths of stroke of two or more hydraulic or pneumatic power pistons moving in parallel with each other. Thus, if an external force is applied in a downward direction to the left-hand piston rod **80*a*, for example, the resulting downward movement of the power piston 90 forces the oil or other fluid within the corresponding space 100 through the cross-connection 100*a* to the space 100 above the right-hand power piston 90, thereby producing a corresponding downward movement of this latter piston. As the right-hand piston 90 moves downwardly it forces fluid from the corresponding space 99 through the cross-connection 99*a* to the space 99 above the left-hand piston to maintain the system in balance. The system is designed such that the two pistons 90** move equal distances in precise synchronization with each other. The precision of synchronization necessary in practice is extremely high and may be required to range up to ±0.01 mm.

This high degree of precision calls for a similarly high degree of precision of the displacement volumes of the synchronizing cylinders; although such precision may be obtained without any substantial difficulty in view of the physical construction, in practice, however, this precision—apart from leakage the automatic correction of which has been explained above in connection with FIG. 2—is decidingly reduced by the following two facts:

(1) The oil volume of the synchronized cylinders which is supposed to be maintained at exactly the same level during the synchronizing operation, decreases with increasing compression (by 3% already at 500 bars) and with increasing oil temperature.

(2) The seals or gaskets (without thereby inducing leaks) resiliently yield to the oil pressure such that the swept volume slightly increases with increasing oil pressure. Now, when the mechanical synchronizing force is multipled by the error or variation in length of stroke designated with Δs, then the product represents a quantity of energy which is missing at the output side, and which is not lost, however, but which is recovered e.g. as work of compression in the oil and as work of deformation during the elastic yielding of the sealing rings or gaskets. On the basis of this consideration, it follows that a correction of the path (length) of stroke of the synchronized pistons is possible only if auxiliary energy is supplied in metered quantity from the exterior in the form of pressurized oil.

In the apparatus shown, this is achieved by having associated with each synchronizing cylinder 80 coaxially thereto a metering cylinder 81 of any desired diameter, but with the same length of stroke. The piston 82 of such metering cylinder is rigidly coupled to the piston rod 80*a* of the synchronized cylinder 80. The variation of volume in the associated metering cylinder 81 above and below the piston 82 as caused by the improper piston position, results in displacement of the control piston 84 of a control cylinder 83 as the (swept) volumes 85 and 86 of the control cylinder 83 are hydraulically connected to the cylinder chambers 87 and 88 of the metering cylinder 81. As the piston areas (faces) 89 of the control piston 84 are substantially smaller than the surface areas of the piston 82, the thus obtained distance of displacement of adjustment of the control piston 84 corresponds to $$S = \ddot{U}_1 \cdot \Delta s$$

wherein the transmission ratio $U_1$, as a ratio of piston areas A 82/A 89, may amount to 300 and more. In this way, variation of the position of the synchronized pistons 90 equal to $\Delta s = \pm 0.01$ mm corresponds to a distance of travel of the control piston equal to $0.01 \times 300 = 3$ mm and more. The control piston 84 is rigidly coupled, via its piston rod 91, to a spool-type slide valve 92 of conventional construction, with the control distance of said valve corresponding to the distance of adjustment $\Delta s$. In case that the transmission ratio $U_1$ determined by design, and therefore the distance of adjustment or the control distance $\Delta s$, does not correspond to the distance of adjustment, the transmission ratio $U_1$ may be increased or decreased correspondingly by the interposition of conventional pressure/travel transducers 93 into the hydraulic connection lines 94, 95.

The pressurized oil supply regulating the position of stroke is effected through a cylinder combination comprising, for example, a centrally positioned power cylinder 96 and a pair of driving cylinders 97 and 98 disposed at the sides of, and in coaxial relation with, the cylinder 96. The two oil volumes 99 and 100 of the synchronized cylinders are hydraulically connected through oil conduits 103 and 104 to the corresponding oil volumes 101 and 102 of the power cylinder 96. With the spaces 99 and 100 having equal volumes, the power piston 105 is positioned centrally within the cylinder, with spaces 101 and 102 being of identical volume. However, if, for example, the seals or gaskets have deformed as described in paragraph (2) above in a manner which causes the pistons 90 to become misaligned and produce a variation $\Delta s$ in the length of stroke, the system is effective to apply a synchronizing force to the pistons to reduce the variation in stroke to zero. If as a result of this misalignment the volume of space 100 in the right-hand synchronized cylinder 80, for example, becomes smaller, or the volume of space 99 becomes larger, than the preset value, the increase in volume produces a decrease in the pressure within the space 99. This pressure decrease is transmitted through the hydraulic line 104 and the transducer 108 to the space 102 on the right side of the power piston 105, thereby tending to displace the power piston 105 to the right of FIG. 3. At the same time as the piston 105 tends to move to the right, however, the decrease in pressure within the space 99 produces a corresponding decrease in the pressure within the metering space 88, and this decrease is transmitted through the transducer 93 and the hydraulic line 95 to the space 86 on the right side of the control piston 84, thereby displacing the piston 84 to the right. The displacement of the control piston 84 results in applying, through the piston rod 91 and the slide valve 92, an oil pressure $p_{zus}$ to the right side of the driving piston 106, which oil pressure exceeds the operating pressure $p_1$ (at the space 100 in the left-hand synchronized cylinder). Consequently, the power piston 105 is not moved to the right, but rather to the left of FIG. 3. This movement forces oil from the oil volume 101 through the line 103 to the space 100 to increase the volume of the space 100 and thereby urge the corresponding piston 90 toward its initial position in line with the associated piston 90. The movement of the power piston 105 continues over a distance until the difference in strokes $\Delta s$ between the two pistons 90 is zero; in this piston position, the operating pressure $p_{zus}$ decreases to the basic pressure $p_o$ of the system.

The driving piston 106*a* operates in analogous manner when the volume 99 of the synchronizing cylinders becomes too small by the factor $\Delta v$ and volume 100 increases excessively.

In this case, too, the constructional transmission ratio $\ddot{U}_2 = V$ 99/V 102 may be decreased or increased by the interposition of pressure/travel transducers 107, 108.

The inherently small dimensions of the control cylinder 83 (diameter about 10 mm), of the spool-type slide valve 92 and of the cylinder combination 96, 97, 98 permit a compact block or modular construction to be employed.

Both the synchronized cylinders 80 and the associated cylinders 81 are subjected to a basic pressure $p_0 > 0.1$ bar, whereby, as explained in connection with FIG. 2, leakage oil losses may be compensated for and the entry of air into the hydraulic system is prevented. If there is a leakage loss in, say, the space 100 in the left-hand cylinder 80, the pressure in the spaces 100 in both of the cylinders 80 tends to decrease. The resulting tendency of the piston in the left-hand cylinder to drop and the piston in the right-hand cylinder to rise is prevented by the continuous supply of oil at the basic pressure $p_0$ to the line 103. The oil flows from the line 103 into the spaces 100 to maintain the pistons in their correct positions.

FIG. 4 shows the fundamental arrangement of the hydraulic circuit of the control device according to FIG. 3 in the case of more than two (e.g. four) synchronized cylinders.

Each synchronized cylinder 80 including the auxiliary cylinder 81 has associated therewith a control cylinder 83 including a slide valve 92 and a cylinder combination 96, 97, 98. The present arrangement of the hydraulic connection paths provides for a simultaneous, automatic correction of the piston stroke differences $\Delta s_1$, $\Delta s_2$, $\Delta s_3$, $\Delta s_4$ relative to each other, by having each volume value in the conduits 109, 110, 111 and 112 initiating a corresponding control pulse, and by supplying replenishing oil to each swept volume 113, 114, 115 and 116 of the synchronizing cylinders, if necessary.

What we claim is:

1. A power piston apparatus comprising, in combination:

a plurality of hydraulic piston drive means, each of the drive means having an enclosed cylinder and a double acting piston within the cylinder to divide the same into a pair of fluid spaces;

means for connecting the hydraulic piston drive means in operative relationship with each other, the connecting means including means for hydraulically connecting a fluid space of one of the enclosed cylinders to a fluid space of the other enclosed cylinder;

a plurality of metering means, one for each of the drive means, each of the metering means having an enclosed metering cylinder and a metering piston within the metering cylinder and connected to the corresponding drive means piston;

control means for detecting movement of at least one of the drive means pistons to an incorrect position, the control means having a control cylinder, a control piston within the control cylinder, and means for hydraulically connecting the control cylinder to at least one of said enclosed cylinders;

means operable in response to the control means for correcting the position of said one drive means piston, the correcting means having a power cylinder, a double acting power piston within the power cylinder, and a hydraulic connection between the power cylinder and the cylinder for said one drive means piston; and means connected to the control piston for operating the correcting means to restore said one drive means piston to its correct position.

2. A power piston apparatus as defined in claim 1, in which the means for operating the correcting means includes a slide valve for supplying hydraulic fluid to the power cylinder.

3. A power piston apparatus comprising, in combination:

a plurality of hydraulic piston drive means, each of the drive means having an enclosed cylinder and a double acting piston within the cylinder to divide the same into a pair of fluid spaces;

means for connecting the hydraulic piston drive means in operative relationship with each other, the connecting means including means for hydraulically connecting a fluid space of one of the enclosed cylinders to a fluid space of the other enclosed cylinder;

means for supplying hydraulic fluid under positive pressure to the fluid spaces of each of the enclosed cylinders;

a plurality of metering means, one for each of the drive means, each of the metering means having an enclosed metering cylinder in coaxial relationship with the corresponding drive means cylinder and a metering piston within the metering cylinder and connected to the corresponding drive means piston;

control means for detecting movement of at least one of the drive means pistons to an incorrect position, the control means having a control cylinder, a control piston within the control cylinder, and means for hydraulically connecting the control cylinder to at least one of said enclosed cylinders;

means operable in response to the control means for correcting the position of said one drive means piston, the correcting means having a power cylinder, a double acting power piston within the power cylinder, and a hydraulic connection between the power cylinder and the cylinder for said one drive means piston; and means connected to the control piston for operating the correcting means to restore said one drive means piston to its correct position.

4. A power piston apparatus comprising, in combination:

a plurality of hydraulic piston drive means, each of the drive means having an enclosed cylinder and a double acting piston within the cylinder to divide the same into a pair of fluid spaces;

means for connecting the hydraulic piston drive means in operative relationship with each other, the connecting means including means for hydraulically connecting a fluid space of one of the enclosed cylinders to a fluid space of the other enclosed cylinder;

means for supplying hydraulic fluid under positive pressure to the fluid spaces of each of the enclosed cylinders, said last-mentioned means having check valves for each of said cylinders for replenishing leakage fluid therefrom;

a plurality of metering means, one for each of the drive means, each of the metering means having an enclosed metering cylinder in coaxial relationship with the corresponding drive means cylinder and a metering piston within the metering cylinder and connected to the corresponding drive means piston;

control means for detecting movement of at least one of the drive means pistons to an incorrect position, the control means having a control cylinder, a control piston within the control cylinder, and means for hydraulically connecting the control cylinder to at least one of said enclosed metering cylinders;

means operable in response to the control means for correcting the position of said one drive means piston, the correcting means having a power cylinder, a double acting power piston within the power cylinder, a hydraulic connection between the power cylinder and the cylinder for said one drive means piston, and hydraulic operating means for the power piston; and means including a slide valve connected to the control piston for operating the correcting means to restore said one drive means piston to its correct position.

5. A power piston apparatus as defined in claim 4, which further comprises, in combination:

a pressure/travel transducer interposed in said hydraulic connection between said power cylinder and said cylinder for said one drive means piston.

6. A power piston apparatus as defined in claim 4, in which said control cylinder is hydraulically connected to the enclosed metering cylinder in each of said metering means.

7. A power piston apparatus as defined in claim 6, which further comprises, in combination:

a plurality of pressure/travel transducers respectively interposed in the hydraulic connections between the control cylinder and the metering cylinders.

* * * * *